United States Patent [19]

Pilliez

[11] Patent Number: 4,813,112

[45] Date of Patent: Mar. 21, 1989

[54] METHOD FOR REINFORCING BY MEANS OF SMALL PLATES AT LEAST END ROWS OF TUBES ENGAGED INTO TUBE END PLATES FOR CONSTITUTING A HEAT EXCHANGER

[75] Inventor: Jacques Pilliez, Laval, France

[73] Assignee: Societe Anonyme des Usines Chausson, Hauts de Seine, France

[21] Appl. No.: 479,808

[22] Filed: Mar. 28, 1983

[30] Foreign Application Priority Data

Apr. 16, 1982 [FR] France ..... 82 06566

[51] Int. Cl.[4] ..... B21D 53/02

[52] U.S. Cl. ..... 29/157.3 C; 29/515

[58] Field of Search ..... 165/79, 173, DIG. 9; 29/515, 157.3 C, 157.3 R

[56] References Cited

U.S. PATENT DOCUMENTS 4,234,041 11/1980 Melnyk ..... 165/173
4,272,006 7/1981 Kao ..... 165/79 X
4,327,800 5/1982 Miller ..... 165/79

FOREIGN PATENT DOCUMENTS 2449070 5/1975 Fed. Rep. of Germany ..... 165/173

*Primary Examiner*—Timothy V. Eley
*Attorney, Agent, or Firm*—Browdy and Neimark

[57] ABSTRACT

For reinforcing the connection between the tubes of a heat exchanger and the tube end plate in which they are engaged, the tube end plate is formed by punching for delimiting collars having a bevelled end and forming bulged bottoms between the collars, then a small plane plate is applied on the bulged bottoms, the small plane plate being brazed in the same time as the tubes and the tube end plate.

5 Claims, 1 Drawing Sheet

METHOD FOR REINFORCING BY MEANS OF SMALL PLATES AT LEAST END ROWS OF TUBES ENGAGED INTO TUBE END PLATES FOR CONSTITUTING A HEAT EXCHANGER

BACKGROUND OF THE INVENTION

The present invention relates to heat exchangers and more particularly to heat exchangers used as coolers, for example as cooling radiators of a heat engine.

Although not exclusively, the invention relates more particularly to heat exchangers used on heavy-truck vehicles the end tubes of which are often submitted to important stresses, both thermal and mechanical stresses, which makes it necessary to reinforce the connection between the tubes and the tube end plates.

The hereinabove mentioned problem is well-known of the man skilled in the art, and it has already been proposed to reinforce the tube end plates near the end rows of tubes. For doing so, it has been proposed to place reinforcing plates engaged on the ends of the tubes either above or beneath the tube end plates.

Applicant has already proposed in French Pat. No. 73 39956 (published under N° 2,250,973) to make reinforcing plates forming successive corrugations in the top of which are made apertures for passing the tubes, these corrugations being used for holding the brazing alloy between them and the top of a tube end plate. It results therefrom that the connection between the tubes and the tube end plates is considerably reinforced.

It has been shown in use that the solutions as proposed were satisfactory by permitting the heat exchangers to resist both mechanical and thermal stresses. However, it has appeared that the improvement which has been brought, although satisfactory for the present obligations of use, did not reach the degree which could be expected.

Another solution had also been proposed in British Pat. No. 622,421 in which two tube end plates form opposite collars.

The state of the art concerning connection between a tube end plate and tubes is also shown by German Pat. No. 703,758; British Pat. Nos. 1,288,561 and 731,431; French Pat. No. 73-27198 (published under No. 2,238,545); and U.S. Pat. Nos. 2,488,627; 2,229,207; and 4,272,006.

It has then been found that the connections through brazing between the reinforcing plates, on the one hand, and the tube end plate and tube, on the other hand, were not perfect because of defects in the brazing alloy which were due to a presence of bubbles following boiling of the flux solvent.

According to the invention, it has consequently been found that it was necessary to reduce as far as possible the defects of the brazing alloy and be sure that a flow of brazing alloy is suitably made upon the connecting step i.e. without the presence of the above-mentioned bubbles.

SUMMARY OF THE INVENTION

According to the invention, the method for reinforcing by means of small plates at least end rows of tubes engaged into tube end plates for constituting a heat exchanger is characterized by forming the tube end plate by punching in order (1) to delimit collars in the tube end plate with said collars having an irregular bevelled end, and (2) to bulge bottom of the parts separating two successive tube passages in the tube end plate so as to form bulged parts;

applying an apertured small plane plate on said bulged parts, said small plane plate having apertures corresponding to the tubes and thereby forming a unit;

fluxing the formed unit with a flux; and brazing the fluxed unit with a brazing alloy, intervals between the bulged parts of the tube end plate and plane parts of the small plane plate forming capillary flowing circuits for the brazing alloy, thereby washing off the flux from said intervals.

BRIEF DESCRIPTION OF THE DRAWINGS

One embodiment of the present invention is shown for illustrating purposes in the accompanying drawing, in which.

DESCRIPTION OF A PREFERRED EMBODIMENT

Figure 1:
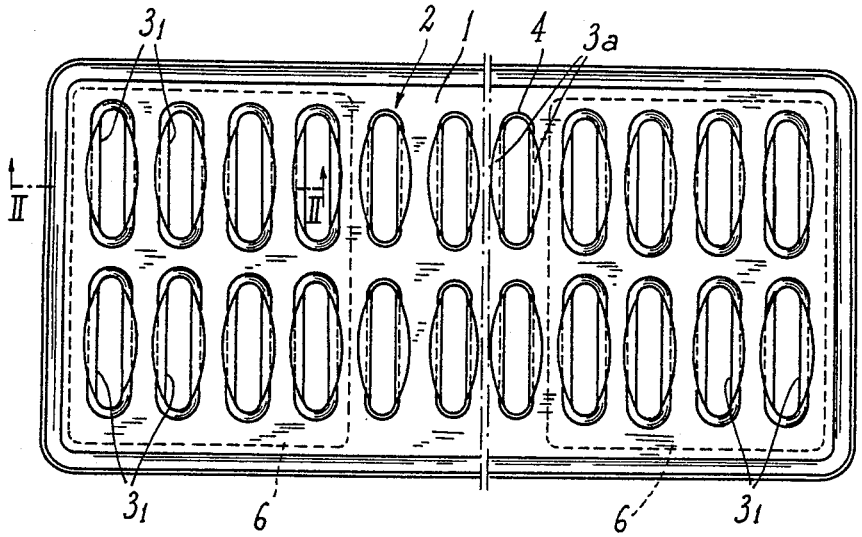
FIG. 1 is a top plane view of the tube end plate of a heat exchanger with circulation tubes comprising the reinforcing means of the invention.

In the drawing, a tube end plate 1 of a rectangular shape forms tube passages 2 for tubes 3. The tube end plate 1, which is made of metal, is formed by punching so that the tube passages 2 are formed with collars 4 having an irregular a bevelled end part 4. The tubes 3 are engaged into the collars 4, and their upper end is enlarged as shown at 3*a* above the bevelled part 4*a*.

Figure 2:
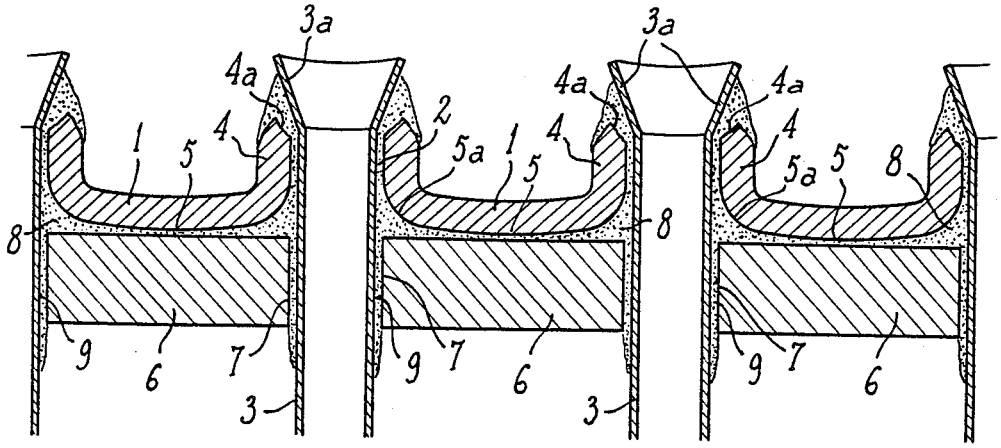
FIG. 2 is an enlarged cross-sectional view taken along line II—II of FIG. 1.

This embodiment of the tube end plate by a punching operation has for its supplementary effect that the bottom 5 of intervals separating the collars is not plane but conversely bulged as shown in FIG. 2, the radius of curvature decreasing near the part connecting the bottom 5 to the flange of the collars 4, as shown at 5*a*.

For reinforcing the tube end plate, at least near the end tubes, i.e. the tubes shown at $3_1$ in FIG. 1, small plates 6 are positioned extending on some rows of tubes, for example four rows of tubes as shown. The small plates 6 are completely planar, and apertures 7 are provided in their thickness, by means of cutting tools which permits the edge of the apertures 7 to have regular edges in contrast to the edge of the bevelled parts 4*a* made by punching which are irregularly shaped; the shape of the apertures 7 corresponds to that of the tubes, and the size of the apertures 7 are slightly larger than that of the tubes 3.

The small plates 6 are mounted so that they are in contact with part of the bottom of the tube end plate, i.e. with the bottom of the bulged part 5. There is thus provided capillary intervals 8 between the tube end plate and the bottom of each small plate, the capillary intervals 8 communicating with capillary intervals 9 provided between the apertures 7 of the samll plate 6 and the outer wall of the tubes 3. After assembling the tubes with the small plates and the tube plate to form a unit, fluxing and then fixing of the unit so formed is carried out by, for example, a soft brazing or soldering by means of a tin-lead alloy or the like, which alloy when melted flows in the capillary intervals 8, 9 as described above, and washes off the flux from the capillary intervals 8, 9 so that no flux remainders will be retained. Actually, since the intervals 8, 9 are of a capillary nature, the soldering alloy, when melted, necessarily flows in all parts of the capillary intervals and consequently pushes off the flux which could be therein for permitting a suitable wetting of the metal by the brazing alloy without presence of any bubbles of flux solvent.

Obviously, the present invention is not limited to the precise construction and arrangement shown and described as the same may be variously modified. In particular, it is possible to provide the small plates 6 extending on all the surface of the tube plates 1.

I claim:

1. A method for reinforcing by means of small plates at least end rows of tubes engaged into tube end plates for constituting a heat exchanger, characterized by the steps of:

forming the tube end plate by punching in order (1) to delimit collars in the tube end plate with said collars having an irregular bevelled end, and (2) to bulge bottom of the parts separating two successive tube passages in the tube end plate so as to form bulged parts, applying an apertured small planar plate on said bulged parts, said small planar plate having apertures corresponding to the tubes, said applied plate and said bulged parts thereby forming a unit;

fluxing the formed unit with a flux; and brazing the fluxed unit with a brazing alloy, intervals between the bulged parts of the tube end plate and planar parts of the small planar plate forming capillary flowing circuits for the brazing alloy, thereby washing off the flux from said intervals.

2. The method according to claim 1, wherein end of the tubes is enlarged above the bevelled parts of the collars for permitting also a flow of the brazing alloy and retention thereof.

3. The method according to claim 1, wherein the apertures made in the small plane plate have a shape corresponding to that of the tubes but a size very slightly larger than outer size of said tubes.

4. The method according to claim 1, wherein a plurality of small plates are provided in relation with a same tube plate.

5. The method according to claim 1, wherein a same small plate extends on all the bottom surface of the tube end plate.

* * * * *